United States Patent [19]

Matoba et al.

[11] Patent Number: 4,600,047

[45] Date of Patent: Jul. 15, 1986

[54] PROCESS FOR CONTROLLING THE MOLTEN METAL LEVEL IN CONTINUOUS THIN SLAB CASTING

[75] Inventors: Yoshiyuki Matoba, Kawanishi; Yoshisuke Misaka, Takarazuka; Yasutake Ohhashi, Nishinomiya; Tsutomu Takamoto, Minoo; Yutaka Hirata, Saga, all of Japan

[73] Assignee: Sumitomo Metal Industries, Ltd., Osaka, Japan

[21] Appl. No.: 701,671

[22] Filed: Feb. 14, 1985

[30] Foreign Application Priority Data

Mar. 29, 1984 [JP] Japan ..... 59-59489
Mar. 29, 1984 [JP] Japan ..... 59-59490
Mar. 29, 1984 [JP] Japan ..... 59-59491

[51] Int. Cl.[4] ..... B22D 11/20; B22D 11/18

[52] U.S. Cl. ..... 164/453; 164/452; 164/454; 164/481

[58] Field of Search ..... 164/4.1, 155, 156, 427–434, 164/437, 439, 449–453, 479–482, 488, 454

[56] References Cited

U.S. PATENT DOCUMENTS 2,380,109 7/1945 Hopkins ..... 164/450
2,804,665 9/1957 Harter et al. ..... 164/449
2,852,821 9/1958 Pond ..... 164/432
3,431,971 3/1969 Gyongyos ..... 164/434
3,478,808 11/1969 Adams ..... 164/454
3,921,697 11/1975 Petry ..... 164/432
4,173,250 11/1979 Houdion ..... 164/434
4,217,947 8/1980 Gyongyos et al. ..... 164/488
4,276,921 7/1981 Lemmens et al. ..... 164/431

*Primary Examiner*—Nicholas P. Godici
*Assistant Examiner*—Richard K. Seidel
*Attorney, Agent, or Firm*—Burns, Doane, Swecker and Mathis

[57] ABSTRACT

A process for controlling the molten metal level in continuous thin slab casting in which molten metal poured from a large-sized tundish into a small-sized tundish through a sliding nozzle is caused to overflow from the small-sized tundish for casting through a tiltable casting spout into a twin-belt-type continuous casting machine is disclosed. The process comprises measuring the level of molten metal on the casting machine to provide a deviation signal representative of a deviation of the level of the molten metal from a target value; and adjusting a directly influencing factor on the molten metal level, such as a pouring rate of the molten metal into the mold and a pulling speed of the molten metal according to the deviation signal. Preferably, the process further comprises measuring the directly influencing factor to provide a deviation signal representative of the directly influencing factor relative to the normal value, and adjusting the degree of opening of the sliding nozzle of the large-sized tundish according to the deviation signal to regulate the pouring rate into the small-sized tundish.

7 Claims, 10 Drawing Figures

PROCESS FOR CONTROLLING THE MOLTEN METAL LEVEL IN CONTINUOUS THIN SLAB CASTING

BACKGROUND OF THE INVENTION

This invention relates to a process for controlling the molten metal level in continuous thin slab casting and more particularly to a process for controlling the molten metal level in continuous thin slab casting by regulating the amount of pouring metal in accordance with changes in the molten metal level.

In continuous casting, recent manufacturing trends are to produce small-sized thin slabs rather than large-sized ones. However, in order to cast such thin slabs, since not only the cross-sectional area of the slab is small but also the ratio of the thickness to the width is small, the molten metal level during casting greatly varies due to even slight fluctuations in the casting conditions. Also, since high speed casting is required for higher productivity, the control of the molten metal level must be highly responsive even with respect to a large fluctuation of the molten metal level as discussed above.

In conventional large-sized continuous slab casting as shown in FIG. 1, a flow of molten steel 1 is supplied from a ladle 2 into a tundish 3 and then from the tundish 3 into a mold 4. The molten metal level 5 is measured by a suitable detector means 6, which generates a deviation signal representative of the deviation of the measured value from a target value when the casting conditions are changed. The deviation signal is supplied to a regulator 7 which controls a hydraulic servo-valve mechanism 8 to regulate the degree of opening of the valve of the sliding nozzle 9 of the tundish 3. In this manner, the casting flow rate of the molten metal flow 1 from the tundish 3 is regulated to control the molten metal level 5.

The inventors of the present invention have previously proposed a process for continuous thin slab casting, which may be called a three-step metal pouring method, in which the molten metal poured from a large-sized tundish into a small-sized tundish through a sliding valve nozzle is caused to overflow from the small-sized tundish to be poured into a belt-type continuous casting apparatus through a casting spout, whereby a cast slab can be pulled by the movement of the belt.

If the conventional molten metal level control technique as previously discussed in conjunction with FIG. 1 is to be applied to the continuous thin slab casting method described above, the first measure would be to measure the metal level in the casting mold and to regulate the degree of opening of a nozzle valve on the outlet side of the large-sized tundish according to the amount of deviation of the measured value from the target value, thereby controlling the flow rate of the molten metal. However, according to experiments conducted by the inventors of the present invention, the time delay in the change in the molten metal level after a change in the degree of opening of the valve of the sliding nozzle of a large-sized tundish is extremely long; while the time delay is on the order of 0.1 to 0.3 seconds in the conventional method shown in FIG. 1, the time delay in the above-described three-step metal pouring method would be at least ten times as large. Thus, it was determined that as long as the conventional, simple control method is utilized, the accuracy of control is poor no matter how the control gain of the regulator is adjusted, making stable operation almost impossible.

Also, according to the experimental results obtained by the inventors of the present invention with the simple metal level control method utilizing the opening degree of the sliding nozzle, when a disturbance consisting of a sudden expansion or contraction of the nozzle cross-sectional area by 15% is experienced, the molten metal level is changed by at least 17 mm, while the required accuracy is $\pm 3$ mm. It has also been determined that, where a thin slab having a small thickness compared to the width is cast at a high speed as is done in belt-type continuous casting, the rapid lowering of the metal level in the mold causes the metal level to go out of control, and in an extreme case, the mold may be emptied, making continuous casting impossible. Alternatively, the molten metal may overflow from the mold, creating a very dangerous situation.

SUMMARY OF THE INVENTION

Accordingly, an object of the present invention is to provide a process for controlling the molten metal level having superior responsiveness in a twin-belt-type continuous casting apparatus in continuous thin slab casting.

Another object of the present invention is to provide a process for controlling at a higher response speed the molten metal level in a twin-belt-type continuous casting apparatus which varies in accordance with various disturbances due to changes in the casting conditions during casting in continuous thin slab casting.

Still another object of the present invention is to provide a process for controlling at a higher response speed the molten metal level in a continuous casting apparatus for the three-step metal pouring method by regulating the rate of casting or pulling in accordance with various disturbances due to changes in the casting conditions generated in the metal pouring system and the pulling system during casting in a continuous thin slab casting.

In summary, the present invention resides in a process for controlling the molten metal level in continuous thin slab casting in which molten metal poured from a large-sized tundish into a small-sized tundish through a sliding nozzle is caused to overflow from the small-sized tundish for casting through a tiltable casting spout into a twin-belt-type continuous casting machine, comprising the steps of: measuring the level of molten metal on the twin-belt-type continuous casting machine to provide a deviation signal representative of a deviation of the level of the molten metal from a target value; and adjusting a directly influencing factor on the molten metal level, such as a pouring rate of the molten metal into the mold and a pulling speed of the molten metal, i.e. the moving rate for the belt of the twin-belt-type continuous casting machine according to the deviation signal, whereby the level of the molten metal is controlled so as to achieve the target value with high accuracy.

The present invention also resides in a process for controlling the molten metal level in continuous thin slab casting in which molten metal poured from a large-sized tundish into a small-sized tundish through a sliding nozzle is caused to overflow from the small-sized tundish for casting through a tiltable casting spout into a twin-belt-type continuous casting machine, comprising the steps of: measuring the level of molten metal on the twin-belt-type continuous casting machine to provide a deviation signal representative of a deviation of the level of the molten metal from a target value; adjusting a directly influencing factor on the molten metal level, such as a pouring rate of the molten metal into the mold and a pulling speed of the molten metal, i.e. the moving rate for the belt of the twin-belt-type continuous casting machine according to the deviation signal, measuring the directly influencing factor to provide a deviation signal representative of the directly influencing factor relative to the normal value, and adjusting the degree of opening of the sliding nozzle of the large-sized tundish according to the deviation signal of the directly influencing factor to regulate the rate at which molten metal is poured into the small-sized tundish, whereby the level of the molten metal is controlled so as to achieve the target value with high accuracy.

Thus, in one aspect, the present invention resides in a process for controlling the molten metal level in continuous thin slab casting in which molten metal poured from a large-sized tundish into a small-sized tundish through a sliding nozzle is caused to overflow from the small-sized tundish for casting through a tiltable casting spout into a twin-belt-type continuous casting machine, comprising the steps of: measuring the level of molten metal on the twin-belt-type continuous casting machine to provide a deviation signal representative of a deviation of the level of the molten metal from a target value; and adjusting the angle of inclination of the tiltable casting spout relative to the horizontal according to the deviation signal to regulate the rate at which molten metal is poured from the small-sized tundish into the twin-belt-type continuous casting machine, whereby the level of the molten metal is controlled so as to achieve the target value with high accuracy.

According to another aspect of the invention, the step of adjusting the angle of inclination of the tiltable casting spout is achieved by measuring the angle of tilt of the casting spout to provide a tilt angle deviation signal representative of the tilt angle of the casting spout relative to the horizontal to adjust the degree of opening of the sliding nozzle of the large-sized tundish to regulate the rate at which molten metal is poured into the small-sized tundish.

In another embodiment of the present invention, the process comprises the steps of measuring the level of molten metal on the twin-belt-type continuous casting machine to provide a deviation signal representative of the deviation of the level of the molten metal from a target value and controlling a motor operating apparatus for moving belts according to the deviation signal to regulate the pulling speed of the molten metal, whereby the level of the molten metal is controlled so as to achieve the target value with high accuracy.

In still another embodiment, the step of controlling the motor operating apparatus is achieved by detecting the pulling speed to adjust the degree of opening of the sliding nozzle of the large-sized tundish to regulate the rate at which molten metal is poured into the small-sized tundish to control the pulling speed, which has been caused to deviate by the control of the molten metal level, so as to achieve a constant value of the pulling speed, whereby the level of the molten metal is controlled so as to achieve the target value with high accuracy.

In a still further embodiment, the step of controlling the motor operating apparatus is achieved by measuring the weight of the molten metal in the small-sized tundish to detect the deviation from a target weight to adjust the degree of opening of the sliding nozzle of the large-sized tundish to regulate the rate at which molten metal is poured into the small-sized tundish and to regulate the pulling speed, which has been caused to deviate by the control of the molten metal level, whereby the level of the molten metal is controlled so as to achieve the target value with high accuracy.

It is to be noted that the term "belt-type continuous casting apparatus" used herein refers to a casting apparatus having a large width mold defined by a pair of downwardly sloped opposing moving belts suitable for use in continuous casting of a thin slab having a small thickness compared to its width. Also, the term "thin slab" used herein generally refers to a thin slab having a small thickness as compared to its width and in its narrow meaning refers to a slab having a thickness on the order of 5 to 100 mm.

In addition, according to the present invention, the "large"- and "small"-sized tundishes are relative ones. The small-sized tundish is smaller than the large-sized tundish in its dimensions. It is herein to be noted that the casting process to which the present invention is applicable is carried out in three stages; from a ladle to a first tundish, from the first tundish to a second tundish, and then from the second tundish to a continuous casting mold through a casting spout.

BRIEF DESCRIPTION OF THE DRAWINGS

The invention will become more readily apparent from the following detailed description of the preferred embodiments of the present invention taken in conjunction with the accompanying drawings, in which.

DETAILED DESCRIPTION OF THE PREFERRED EMBODIMENTS

Figure 2:
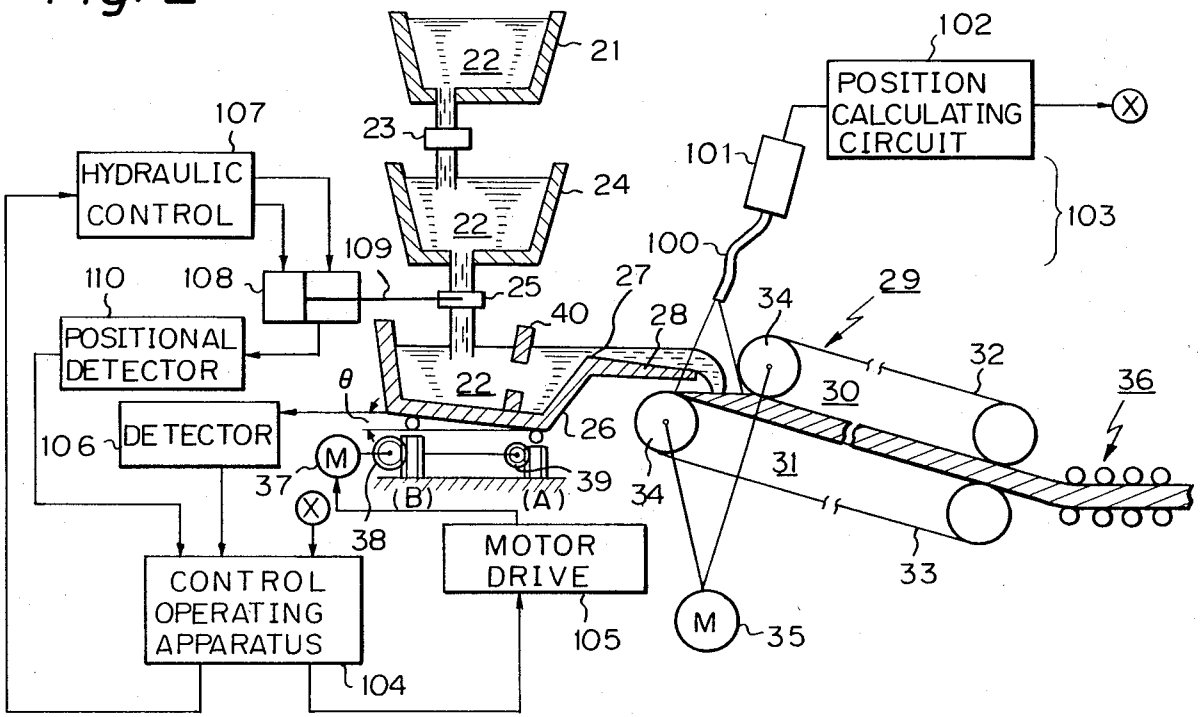
FIG. 2 is a schematic explanatory view of a continuous casting apparatus used in the present invention.

FIG. 2 is a schematic diagram illustrating the construction of a continuous thin slab casting apparatus to which a first embodiment of the molten metal level control process according to the present invention is applicable.

In FIG. 2, molten metal (molten steel) 22 contained in a ladle 21 is poured by way of a sliding nozzle or a stopper nozzle 23 into a large-sized tundish 24 positioned under the ladle 21. Below the large-sized tundish 24, a small-sized tundish 26 is provided so that the melt 22 is poured into the small-sized tundish 26 by way of a sliding nozzle 25 provided at the bottom of the large-sized tundish 24. At the upper edge of the small-sized tundish 26, an overflow orifice 27 and a casting spout 28 are provided in order to allow the molten metal 22 to be poured into the twin-belt-type continuous casting apparatus (hereinafter referred to as a caster) 29 through the casting spout 28. In the caster 29, belts 32 and 33 are wound around an entrance and an exit nip pulley of an upper and a lower belt-roller mechanism 30 and 31. The molten metal 22 from the small-sized tundish 26 is poured into a continuous casting mold formed between the belts 32 and 33. The molten metal 22 solidifies after being poured and is cooled by an unillustrated primary cooling spray zone. The entrance nip pulleys 34 of the upper and the lower belt-roller mechanism 30 and 31 are connected to an electric motor 35, and as the motor 35 rotates, a slab primarily solidified is fed into a secondary cooling zone 36 including a plurality of rollers disposed downstream of the caster 29.

Since the function of the casting spout 28 is to regulate the rate of casting from the small-sized tundish 26 by the adjustment of its tilt angle, the casting spout 28 is preferably integrally formed with the small-sized tundish 26 as shown in the figures. The tilting of the small-sized tundish 26 is achieved by rotating the small-sized tundish 26 about the tip of the casting spout 28. Thus, as long as the small-sized tundish 26 is rotated with the tip of its casting spout 28 kept at the center of rotation, there are no particular limitations on the mechanism for tilting the tundish and any drive mechanism including an electric motor or a hydraulic cylinder may be used. In the illustrated embodiment, the small-sized tundish 26 is supported from below at locations A and B, and the elevations of locations A and B are adjusted by worm gears 38 and 39 driven by an electric motor 37. By moving the small-sized tundish 26 up and down while keeping the ratio of the elevations of the small-sized tundish 26 at the locations A and B constant, the small-sized tundish 26 can be tilted about the tip of the spout 28. Since the tilt angles of the tundish 26 and the spout 28 are equal to each other, the tilt angle of the small-sized tundish 26 may be considered as the tilt angle of the casting spout 28. A slag blocking plate 40 is provided for preventing a change in the molten metal level of the incoming side of the small-sized tundish 26 from being propagated to the casting spout 28.

Figure 1:
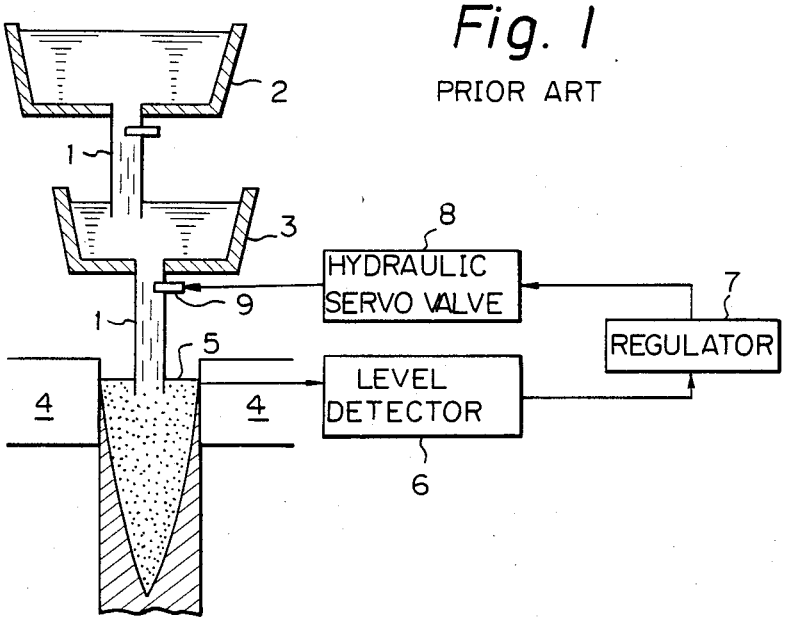
Fig. 1 PRIOR ART
FIG. 1 is a schematic diagram illustrating a conventional control system.
Figure 3:
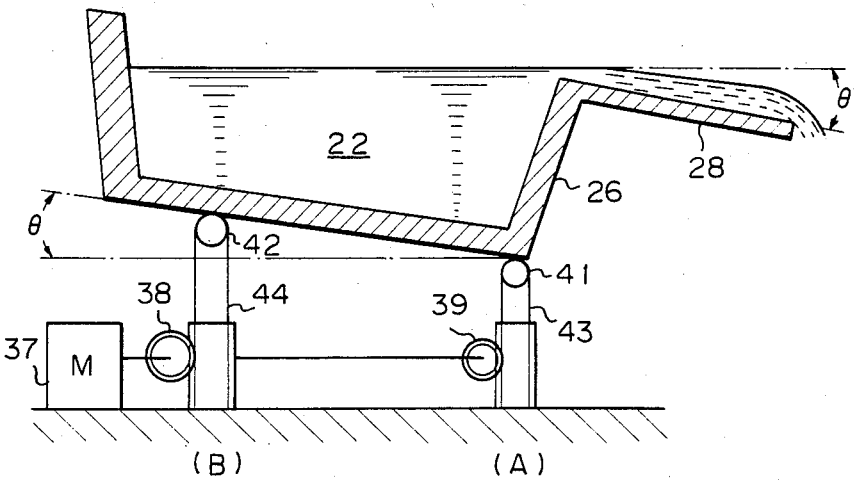
FIG. 3 is an enlarged explanatory view of a portion of the spout tilting mechanism shown in FIG. 2.

FIG. 3 is an enlarged schematic explanatory view showing the mechanism for adjusting the tilt angle of the small-sized tundish 26 as described above, the same reference numerals designating identical components. The small-sized tundish 26 pivot-supported at points 41 and 42 by movable columns 43 and 44 is moved up and down with a constant ratio maintained between the heights of the columns by the worm gears 38 and 39 driven by the motor 37. The tilt angle ($\theta$) of the small-sized tundish 26 which corresponds to the tilt angle of the casting spout 28 can be quickly adjusted in response to changes in molten metal level through the use of the above-described mechanism.

During start up of the continuous thin slab casting apparatus with which the method of the present invention is employed, the rate at which molten metal 22 is poured through the sliding nozzle 25 from the large-sized tundish 24 onto the caster 29 cannot be accurately measured at the initial stage, so that it takes time for stable operation to be reached and changes in pulling speed and significant changes in molten metal level are sometimes experienced. Therefore, in carrying out the present invention, during the start up of the apparatus, the rate at which molten metal 22 is poured from the large-sized tundish 24 into the small-sized tundish 26 is measured to regulate the degree of opening of the sliding nozzle 25 so that the rate at which molten metal 22 is poured into the caster 29 is calculated on the basis of the measured rate of pouring of molten metal 22 and it becomes equal to a target rate, and then the flow rate of the molten metal from the large-sized tundish 24 into the small-sized tundish 26 after regulating the sliding nozzle 25 is measured to obtain a calculated set value of the pulling speed of the caster 29 during pouring, whereby the pulling speed of the caster 29 and the molten metal level are caused to quickly and automatically become equal to their respective target values, enabling a quick transition to steady-state operation.

The present invention covers not only a one-step control method but also a two-step control method, though the present invention will hereinafter be described with reference to the two-step method.

A first embodiment of the present invention comprises the steps of (i-a) metal level control by tilting of the spout, and (i-b) control of the spout tilt angle by adjustment of the degree of opening of the sliding nozzle. These steps (i-a) and (i-b) will now be explained.

(i-a) Metal Level Control by Tilting of Spout

In FIG. 2, detection of the molten metal level (H) in the mold on the side nearest the casting spout is conducted by means of an optical measuring system 103 which comprises an optical fiber 100, a camera 101, and a position calculating circuit 102. In the illustrated embodiments, a change in the brightness of the molten metal 22 on the belt dam block side or in the mold is detected by the camera 101 through the optical fiber 100, and is converted into an electric current which is input to the position calculating circuit 102. The position calculating circuit 102 produces a position signal which is supplied to a control operating apparatus 104. In the control operating apparatus 104, the position signal is compared with a target molten metal level (H*) which is previously set, and based on the difference between the position signal and the target value, a control signal $U_1(t)$ is produced for tilting the pouring spout which is to be input to a motor drive apparatus 105. The calculation of the level of the control signal $U_1(t)$ is as follows:

$$U_1(t) = Kp_1\left[e_1(t) + \frac{1}{T_{I1}}\int_0^t e_1(t)dt + T_{D1}\frac{de_1(t)}{dt}\right] \quad (1)$$

t: Time $e_1(t)$: $H^* - H(t)$

H(t): Molten Metal Level at Caster Entrance Side

H*: Molten Metal Target Level at Caster Entrance Side $Kp_1, T_{I1}, T_{D1}$: Proportional, Integral and Differential Control Gains $U_1(t)$: Spout Tilting Control Signal The signal $U_1(t)$ calculated from Equation (1) is supplied to the pouring spout tilting motor drive apparatus 105, and through the rotation of the motor 37, the pouring spout or the small-sized tundish 26 is tilted to regulate the rate of casting from the small-sized tundish, whereby the molten metal level (H) is controlled so as to approach the target level (H*). When the molten metal level (H) rises due to a disturbance, the tilt angle is decreased by the amount determined by the signal $U_1(t)$ corresponding to the deviation from the original value to decrease the rate of pouring to return the metal level (H) to the target level. Conversely, when the molten metal level (H) falls, the same operation is carried out except that the spout tilting angle is increased. Since a change in spout tilting angle produces a very quick change in casting rate, highly responsive control of the metal level can be realized.

(i-b) Control of Spout Tilt Angle ($\theta$)

The control of the spout tilt angle ($\theta$) by the valve opening degree of the sliding nozzle 25 on the exit side of the large-sized tundish 24 will now be described.

First, the spout tilt angle ($\theta$), as mentioned by the position of the bottom of the small-sized tundish 26, is detected by a detector 106 and this detected position is converted into a current signal. The current signal is input to the control operating apparatus 104. The detector 106 may be one which optically detects the position or the angle, or it may be one which determines the angle by calculation based on the control signal $U_1(t)$ for the motor 37. In the control operating apparatus 104, the signal from the detector 106 is compared with a previously set target angle ($\theta^*$) to calculate the deviation $e_2(t)$ from the target value, thereby obtaining on the basis of the following equation a control signal $U_2(t)$ for opening and closing the valve which is supplied to a hydraulic control apparatus 107.

$$U_2(t) = Kp_2\left[e_2(t) + \frac{1}{T_{I2}}\int_0^t e_2(t)dt + T_{D2}\frac{de_2(t)}{dt}\right] \quad (2)$$

t: Time $e_2(t)$: $\theta^* - \theta(t)$ $\theta^*$: Target Spout Tilt Angle $\theta(t)$: Spout Tilt Angle $Kp_2, T_{I2}, T_{D2}$: Proportional, Integral and Differential Control Gains $U_2(t)$: Valve Opening Control Signal The valve opening control signal $U_2(t)$ calculated from Equation (2) is supplied to the hydraulic control apparatus 107. In the hydraulic control apparatus 107 which consists of an unillustrated electromagnetic valve and a pressure control circuit, the forward and backward movement of the rod 109 with respect to the hydraulic cylinder 108 and the amount of oil supplied to the oil chambers are regulated on the basis of control signal $U_2(t)$, thereby causing the rod 109 to move forward or backward to move the sliding valve connected thereto to open or close the valve of the sliding nozzle 25.

The degree of opening of the valve is detected by a positional detector 110 which measures the movement of the sliding portion of the cylinder 108 and produces an output signal which is input to the control operating apparatus 104 as a feedback signal. Thus, the degree of opening of the valve is regulated, and the rate at which metal is poured from the large-sized tundish 24 is regulated, whereby the spout tilt angle ($\theta$) is regulated so as to approach the predetermined target value ($\theta^*$). Usually, the spout is regulated so as to return to the horizontal ($\theta^*=0$).

For example, when the spout tilt angle ($\theta$) is positive, the signal $U_2(t)$ corresponding to the deviation causes the valve to open, thereby increasing the rate of pouring to the small-sized tundish. Since the molten metal level rises, the spout angle ($\theta$) is decreased accordingly to return to the horizontal position. This is also true for the opposite case.

By the method explained above of double control consisting of a first and a second interconnected control method, i.e., by first controlling the metal level of the caster 29 by the spout tilting operation having a high response speed, and then by returning the spout tilt angle which was changed by the above first control method to a horizontal level, the metal level can be controlled with high accuracy and the spout tilt angle can be maintained close to the horizontal.

A second embodiment of the present invention, comprising the steps of (ii-a) metal level control by pulling speed and (ii-b) control of the pulling speed by the valve opening degree of a sliding nozzle, will now be described.

(ii-a) Metal Level Control by Pulling Speed

The control of the molten metal level of the caster by adjusting the pulling speed will now be described with reference to FIG. 4, in which detection of the molten metal level (H) in the mold on the caster entrance side is conducted in the same manner as described in connection with FIG. 2. The same reference numerals designate identical components.

The signal $U_1(t)$ calculated from the before-mentioned Equation (1) is supplied to the pulling speed adjusting motor drive apparatus 105, and through the rotation of the motor 35, the pulling speed and thus the rate at which metal is removed from the caster is adjusted, whereby the molten metal level (H) is controlled so as to return to the target level (H*). When the molten metal level (H) rises due to a disturbance, the pulling speed is increased by the amount determined by the signal $U_1(t)$ corresponding to the deviation from the target value to increase the amount of pulling to regulate the metal level (H) towards the target level. Conversely, when the molten metal level (H) falls, the same operation is carried out except that the pulling speed is decreased. Since a change in the amount of pulling due to a change in pulling speed is very quick, highly responsive control of the molten metal level can be realized.

(ii-b) Control of Pulling Speed (v)

The control of the pulling speed (v) by the valve opening degree of the sliding nozzle 25 on the exit side of the large-sized tundish 24 will now be described.

Figure 4:
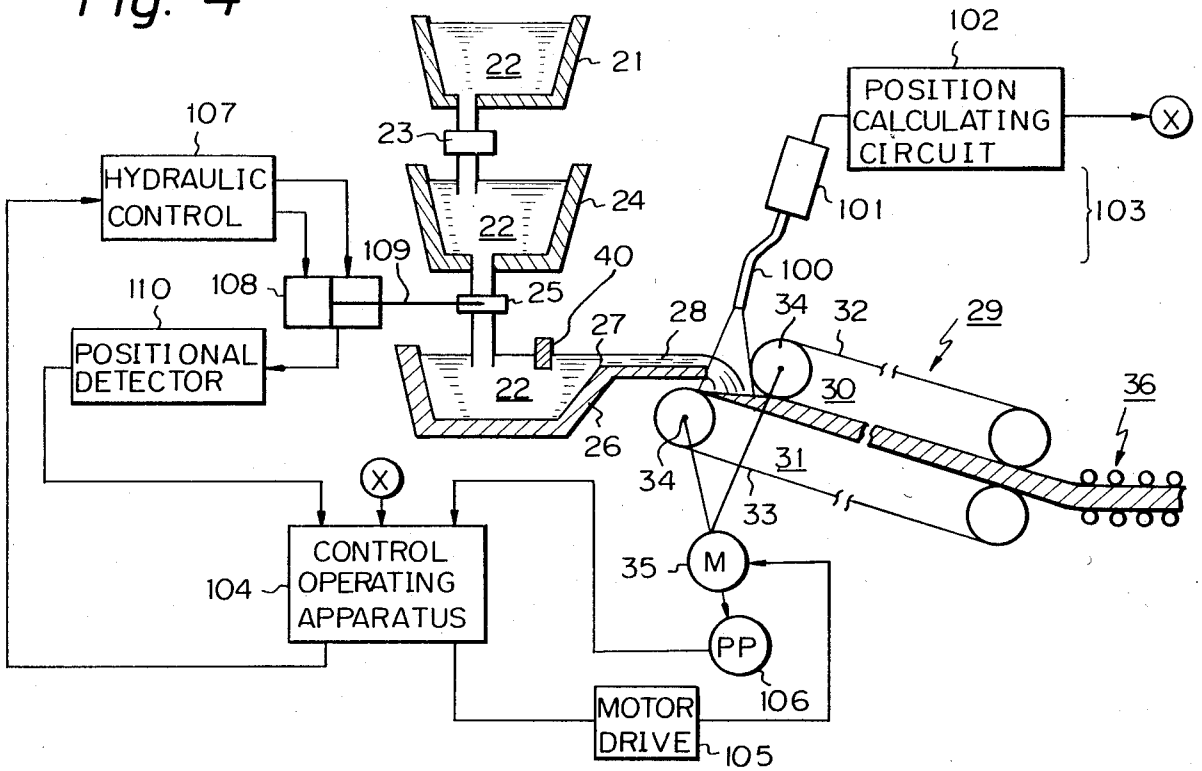
FIG. 4 is a schematic diagram illustrating another continuous casting apparatus used in the present invention.

First, in FIG. 4, the pulling speed (v), that is, the rotational speed of the motor 35 is detected by a detector 106 which produces a corresponding current signal. The current signal is input to the control operating apparatus 104. The detector 106 may be one which optically detects the speed or position change, or it may be one which determines the amount by calculation based on the control signal $U_1(t)$ input to the motor 35. In the control operating apparatus 104, the current signal from the detector 106 is compared with a previously set target pulling speed ($v^*$) to calculate the deviation $e_2(t)$ from the target value, thereby obtaining, on the basis of the following, a control signal $U_2(t)$ for opening and closing the valve which is supplied to the hydraulic control apparatus 107 in accordance with the before-mentioned Equation (2).

In this case, however, the following are to be noted.

$e_2(t)$: $v^* - v(t)$ $v^*$: Target Pulling Speed v(t): Pulling Speed

The valve opening control signal $U_2(t)$ calculated from Equation (2) as in the above is supplied to the hydraulic control apparatus 107 in the same manner as described in connection with FIG. 2.

Thus the degree of opening of the valve is regulated, and the rate at which metal is poured from the large-sized tundish 24 is regulated, whereby the pulling speed (v) is regulated so as to return to the predetermined target value (v*).

For example, when the pulling speed (v) is greater than the target value, the signal $U_2(t)$ corresponding to the deviation causes the valve to close, thereby decreasing the rate of pouring to the small-sized tundish. Since the molten metal level falls, the pulling speed (v) is decreased accordingly to return to the target pulling speed. This is also true for the opposite case.

By the method explained above of double control consisting of a first and a second interconnected control method, i.e., by first controlling the metal level of the caster 29 by the pulling speed adjusting operation having a high response speed, and then by returning the pulling speed which is changed by the above first control to the target pulling speed, the metal level can be controlled with high accuracy and the pulling speed can be maintained close to the target value.

Next, a third embodiment of the present invention, comprising the steps of (iii-a) metal level control by pulling speed and (iii-b) control of pulling speed by control of the caster pouring rate will now be described.

(iii-a) Metal Level Control by Pulling Speed

The control of the molten metal level of the caster by adjusting the pulling speed will now be described with reference to FIG. 5, in which detection of the molten metal level (H) in the mold on the caster entrance side is conducted in the same manner as described in connection with FIG. 2 to provide a control signal $U_2(t)$.

The signal $U_1(t)$ calculated according to the beforementioned Equation (1) is supplied to the pouring spout tilting motor drive apparatus 105, and through the rotation of the motor 35, the pulling speed of the caster is regulated to adjust the rate at which metal is removed from the caster, whereby the molten metal level (H) is controlled so as to approach the target level (H*). When the molten metal level (H) rises due to a disturbance, the pulling speed is increased by the amount determined by the signal $U_1(t)$ corresponding to the deviation from the target value to increase the amount of pulling to regulate the metal level (H) so as to achieve the target level. Conversely, when the molten metal level (H) falls, the same operation is carried out except that the pulling speed is decreased. Since a change in the amount of pulling speed is very quick, highly responsive control of the metal level can be realized.

(iii-b) Control of Pulling Speed by Control of Caster Pouring Rate

The control of the pulling speed (v) by controlling the degree of opening of the valve of the sliding nozzle 25 on the exit side of the large-sized tundish 24 will now be explained.

Figure 5:
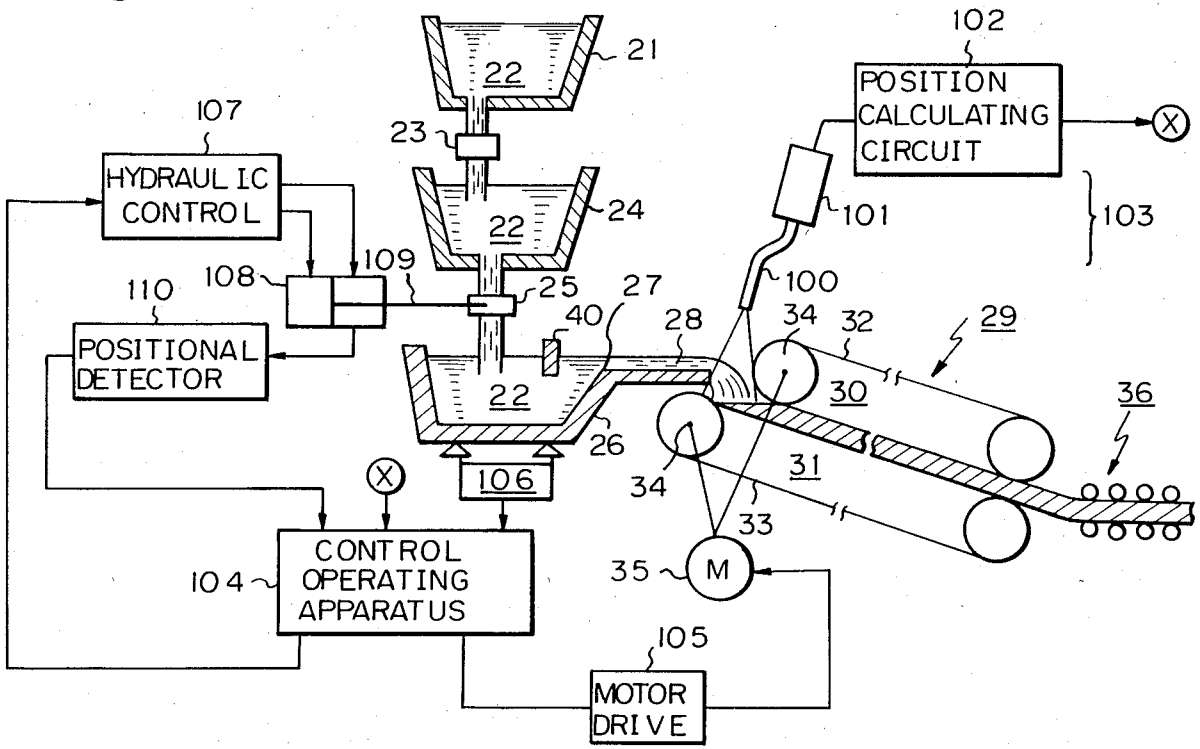
FIG. 5 is a schematic diagram illustrating still another continuous casting apparatus used in the present invention.

First, in FIG. 5, the small-sized tundish weight (w) is detected by the detector 106 and a current signal is produced corresponding to this detected amount. The currrent signal is input to the control operating apparatus 104. The detector 106 may be one which mechanically detects the weight change, or it may be one which determines the weight by calculation based on the rate of casting and the rate of supply. In the control operating apparatus 104, the current signal from the detector 106 is compared with a previously set small-sized tundish weight (w*) and the deviation $e_2(t)$ from the target value is calculated, thereby obtaining, on the basis of Equation (2), a control signal $U_2(t)$ for opening and closing the valve which is supplied to the hydraulic control apparatus 107 in accordance with the beforementioned Equation (2).

In this case, however, the following are to be noted.

$e_2(t)$: $w^* - w(t)$ w*: Target Small-Sized Tundish Weight w(t): Small-Sized Tundish Weight Since the casting rate from the small-sized tundish depends upon the molten metal depth above the casting spout, by measuring the small-sized tundish weight and adjusting the degree of opening of the sliding nozzle of the large-sized tundish according to the deviation from the target weight, a predetermined casting rate is maintained and therefore the pulling speed at that time returns to a predetermined value.

The valve opening control signal $U_2(t)$ calculated from the above-mentioned Equation (2) is supplied to the hydraulic control apparatus 107 in the same manner as described in connection with FIG. 2.

Thus the degree of opening of the valve is regulated, and the rate at which metal is poured from the large-sized tundish 24 is regulated, whereby the small-sized tundish weight (w) is regulated so as to approach the predetermined target small-sized tundish weight (w*).

For example, when the pouring rate into the caster is increased, while the pulling speed (v) becomes larger than the target value due to the control of the metal level by the pulling speed discussed above, the signal $U_2(t)$ corresponding to the deviations relative to the target value for the small-sized tundish weight (w) at that time due to the control of the pulling speed by the pouring rate causes the valve to close, thereby decreasing the pouring rate to the small-sized tundish and decreasing the casting rate. Since the molten metal level decreases, the pulling speed (v) is decreased accordingly to return to the target pulling speed. This is also true for the opposite case.

By the method explained above of double control consisting of a first and a second interconnected control method, i.e., by first controlling the metal level of the caster 29 by the pulling speed adjusting operation having a high response speed, and then controlling the pouring rate into the caster by controlling the degree of opening of the sliding nozzle of the large-sized tundish so that the pulling speed which has been changed by the above first control is returned to the usual target pulling speed, the metal level can be controlled with high accuracy and the pulling speed can be maintained close to the target value.

The present invention will now be further described in conjunction with some working examples which are presented merely for illustrative purposes.

EXAMPLE I

Figure 6:
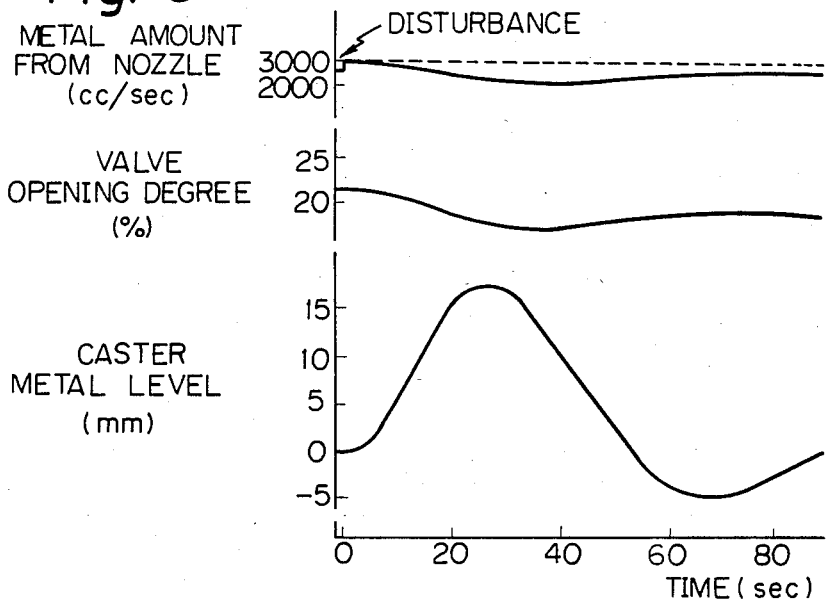
FIG. 6 is a graph showing the results of molten metal level control by a conventional control system.
Figure 7:
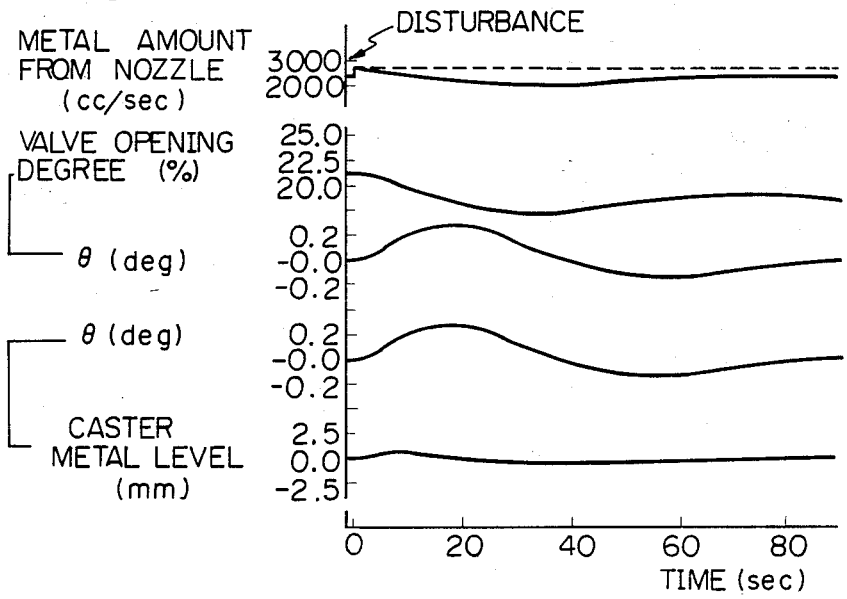
FIG. 7 is a graph showing the results obtained by the caster shown in FIG. 2 according to the present invention.

A thin slab having a cross section of 600 mm × 40 mm was continuously poured at a casting rate of 6 m/min. by the continuous caster shown in FIG. 2. During this procedure, the change in molten metal level was measured by introducing a disturbance, i.e., the cross-sectional area of the sliding nozzle 25 for supplying molten metal from the large-sized tundish 24 to the small-sized tundish 26 was abruptly increased by 15%. For comparison, molten metal level control by the operation of the degree of valve opening by the same caster was also conducted as a prior art method. The result of the control by the prior art method is shown in FIG. 6, while the result of the control by the method of the present invention is shown in FIG. 7.

As is apparent from the illustrated results, the disturbance instantaneously increased the amount of molten metal fed from the nozzle and the metal level rose with a certain time lag. As the control mechanism operated, a gradual recovery was observed.

According to the prior art method (FIG. 6), no matter how the control gain was adjusted, a level change of 17 mm at the smallest was observed while the required accuracy was ±3 mm, and at least 80 seconds were necessary for recovery. Contrary to this, according to the control method of the present invention (FIG. 7), when a rise in metal level due to an increase in supply amount by the above disturbance was detected, the spout tilt angle ($\theta$) was immediately increased to regulate the casting rate so as to limit it. At the same time, the degree of opening of the valve of the sliding nozzle of the large-sized tundish was regulated toward the closed position in order to suppress the increase in the angle ($\theta$), whereby the necessary accuracy of ±3 mm was always achieved for the above disturbance, realizing a stable, rapid and precise control.

As is apparent to a person of ordinary skill in the art, according to the present invention, since the supply rate into the mold from the small-sized tundish is immediately increased or decreased in response to changes in the metal level within the mold to compensate for the changes, and on the other hand, the change in the rate at which metal is supplied from the large-sized tundish to the small-sized tundish immediately responds to the change in casting rate, the accuracy of the metal level control in the mold is improved to further improve the quality of the thin slab.

EXAMPLE II

A thin slab having a cross section of 600 mm×40 mm was continuously poured at a casting speed of 6 m/min. by the continuous caster shown in FIG. 4. During this procedure, the change in molten metal level was measured by introducing a disturbance, i.e., an abrupt 15% increase in the cross-sectional area of the sliding nozzle 25 for supplying the molten metal from the large-sized tundish 24 to the small-sized tundish 26. For comparison, molten metal control by the adjusting operation of the pulling speed by the same caster was also conducted as a comparative method. The result of the control by the comparative method is shown in FIG. 8, while the result of the control by the method of the present invention is shown in FIG. 9.

As is apparent from the illustrated results, the disturbance instantaneously increased the amount of molten metal fed from the nozzle, and the metal level rose with a certain time lag. As the control mechanism operated, a gradual recovery was observed.

Figure 8:
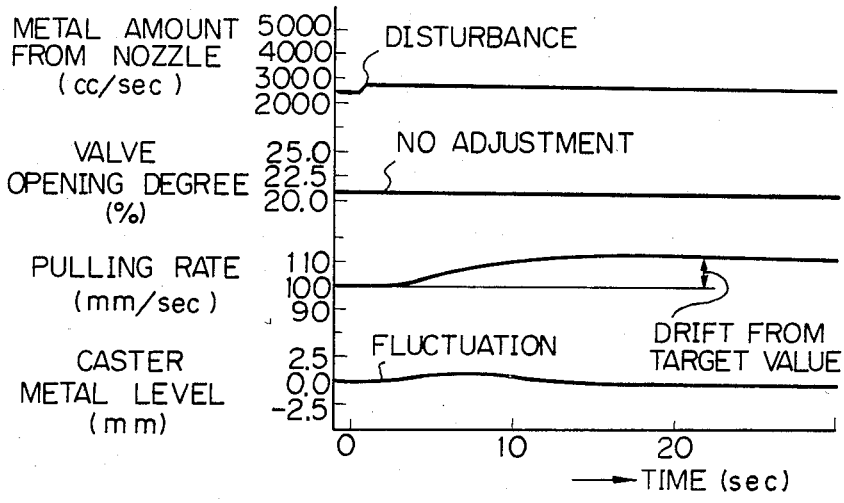
FIG. 8 is a graph showing the results of molten metal level control by a conventional control system.
Figure 9:
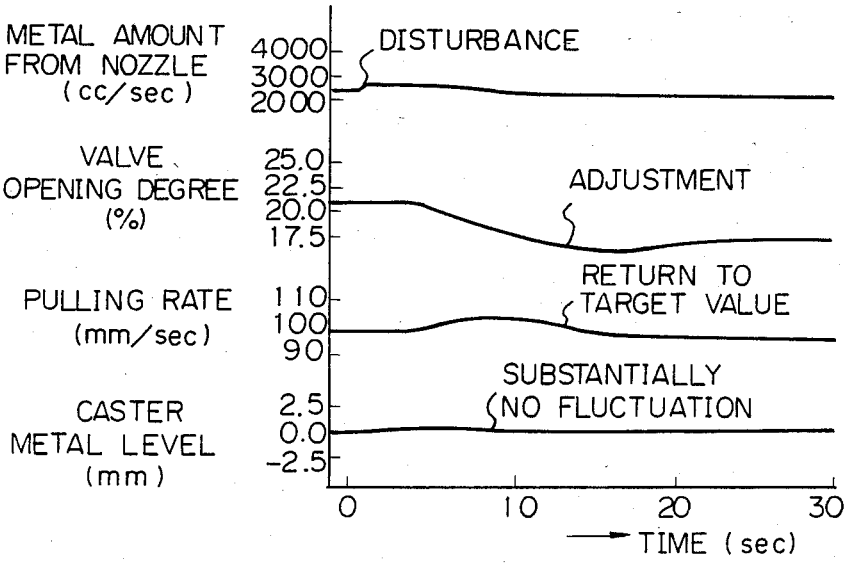
FIG. 9 is a graph showing the results of molten metal level control according to the present invention by the caster shown in FIG. 4.

According to the comparative method, as shown in FIG. 8, while the required accuracy of ±3 mm for the metal level was maintained, the pulling speed drifted, which is undesirable in view of the quality of a slab. Contrary to this, according to the control method of the present invention (FIG. 9), when a rise in metal level due to an increase in the amount supplied by the above disturbance was detected, the pulling speed (v) was immediately increased to return the metal level to the previous level. At the same time, the degree of opening of the valve of the sliding nozzle of the large-sized tundish was regulated toward the closed position in order to suppress the increase in the pulling speed (v), whereby the necessary accuracy of ±3 mm was always achieved for the above disturbance, the pulling speed was always allowed to be at or about the target value, and stable, rapid and precise control was realized.

As is apparent to a person of ordinary skill in the art, according to the present invention, since the supply rate into the mold from the small-sized tundish is increased or immediately decreased by changing the pulling speed (v) in response to changes in molten metal level within the mold to compensate for the changes, and, on the other hand, since the change in the rate at which metal is supplied from the large-sized tundish to the small-sized tundish immediately responds to the change in the pulling speed, the accuracy of the metal level control in the mold is improved to further improve the quality of the thin slab.

EXAMPLE III

Figure 10:
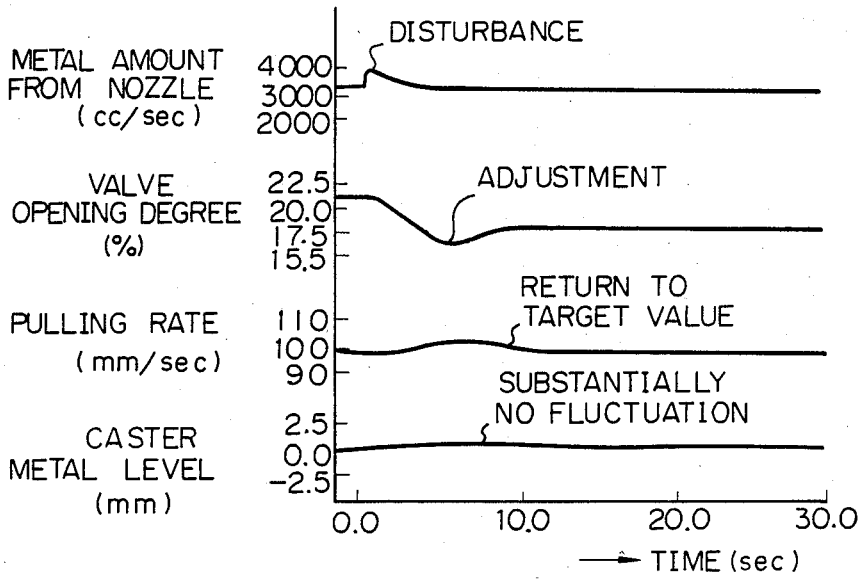
FIG. 10 is a graph showing the results of molten metal level control according to the present invention by the caster shown in FIG. 5.

A thin slab having a cross section of 600 mm×40 mm was continuously poured at a casting speed of 6 m/min. by the continuous caster shown in FIG. 5. During this procedure, the change in molten metal level was measured by introducing a disturbance, i.e., an abrupt increase of 15% in the cross-sectional area of the sliding nozzle for supplying the molten metal from the large-sized tundish to the small-sized tundish. For comparison, molten metal level control by changing the pulling speed by the same caster was also conducted as a comparative method. The result of the control by the comparative method is shown in FIG. 8, while the result of the control by the method of the present invention is shown in FIG. 10.

As is apparent from the illustrated results, the disturbance instantaneously increased the molten metal amount fed from the nozzle and the metal level rose with a certain time lag. As the control mechanism operated, a gradual recovery was observed.

According to the comparative method, as shown in FIG. 8, while the required accuracy of ±3 mm for the metal level was maintained, the pulling speed drifted, which is undesirable in view of the quality of a slab. Contrary to this, according to the control method of the present invention (FIG. 10), when a rise in metal level due to increase in supply amount by the above disturbance was detected, the pulling speed (v) was immediately increased to return the metal level to its previous level. At the same time, the degree of opening of the valve of the sliding nozzle of the large-sized tundish was regulated toward the closed position in order to suppress the increase in the pulling speed (v), whereby control which satisfied the necessary accuracy of ±3 mm was always achieved for the above disturbance, always allowing the pulling speed to be at or near the target value and realizing stable, rapid, and precise control.

As is apparent to a person of ordinary skill in the art, according to the present invention, since the supply rate into the mold from the small-sized tundish is immediately increased or decreased by changing the pouring rate or the pulling speed (v) in response to changes in metal level within the mold to compensate for the changes, and, on the other hand, since the change in the rate at which metal is supplied from the large-sized tundish to the small-sized tundish immediately responds to the change in the pouring rate or the pulling speed (v), the accuracy of the molten metal level control in the mold is improved to further improve the quality of the thin slab.

Although the invention has been described with preferred embodiments it is to be understood that variations and modifications may be employed without departing from the concept of the invention as defined in the appended claims.

What is claimed is:

1. A process for controlling the molten metal level in continuous thin slab casting in which molten metal poured from a large-sized tundish into a small-sized tundish through a sliding nozzle is caused to overflow from the small-sized tundish for casting through a tiltable casting spout into a twin-belt-type continuous casting machine, comprising the steps of:

measuring the level of molten metal on said twin-belt-type continuous casting machine;

comparing the said measured melt level with a target melt level to provide a melt level deviation signal; and adjusting the angle of inclination of said tiltable casting spout relative to the horizontal according to said melt level deviation signal to regulate the rate at which molten metal is poured from said small-sized tundish into said twin-belt-type continuous casting machine, whereby the level of the molten metal is controlled so as to achieve the target level with high accuracy.

2. A process as claimed in claim 1, wherein the process further comprises the steps of measuring the angle of tilt of said casting spout relative to the horizontal;

comparing the said measured tilt angle with a target tilt angle of said casting spout relative to the horizontal to provide a tilt angle deviation signal; and adjusting the degree of opening of said sliding nozzle of said large-sized tundish according to the tilt angle deviation signal to control the tilt angle of said casting spout to the target tilt angle.

3. A process as defined in claim 1, wherein said thin slab has a thickness on the order of 5 to 100 mm.

4. A process for controlling the molten metal level in continuous thin slab casting in which molten metal poured from a large-sized tundish into a small-sized tundish through a sliding nozzle is caused to overflow from the small-sized tundish for casting through a casting spout into a twin-belt-type continuous casting machine, comprising the steps of:

measuring the level of molten metal on said twin-belt-type continuous casting machine;

comparing the said measured melt level with a target melt level to provide a melt level deviation signal;

controlling a motor operating apparatus for moving belts according to said melt level deviation signal to regulate the pulling speed of said casting machine;

measuring the pulling speed of said casting machine;

comparing the measured pulling speed with a target pulling speed to provide a pulling speed deviation signal; and adjusting the degree of opening of said sliding nozzle of said large-sized tundish according to the pulling speed deviation signal to control the pulling speed to the target pulling speed.

5. A process as claimed in claim 4, wherein said thin slab has a thickness on the order of 5 to 100 mm.

6. A process for controlling the molten metal level in continuous thin slab casting in which molten metal poured from a large-sized tundish into a small-sized tundish through a sliding nozzle is caused to overflow from the small-sized tundish for casting through a casting spout into a twin-belt-type continuous casting machine, comprising the steps of:

measuring the level of molten metal on said twin-belt-type continuous casting machine;

comparing the said measured melt level with a target melt level to provide a melt level deviation signal;

controlling a motor operating apparatus for moving belts according to said melt level deviation signal to regulate the pulling speed of said casting machine;

measuring the weight of the molten metal in said small-sized tundish;

comparing the measured weight with a target weight to provide a small-sized tundish weight deviation signal; and adjusting the degree of opening of said sliding nozzle of said large-sized tundish according to the small-sized tundish weight deviation signal to regulate the rate at which molten metal is poured into said small-sized tundish and to regulate the pulling speed which has been deviated by the control of said molten metal level.

7. A process as claimed in claim 6, wherein said thin slab has a thickness on the order of 5 to 100 mm.

* * * * *